US006208327B1

(12) United States Patent
Ho et al.

(10) Patent No.: US 6,208,327 B1
(45) Date of Patent: Mar. 27, 2001

(54) CAMOUFLAGE OF IMAGED POST SPACERS AND COMPENSATION OF PIXELS THAT DEPART FROM NOMINAL OPERATING CONDITIONS BY LUMINANCE DIFFUSION

(75) Inventors: Kenneth C. Ho, Yonkers; Alan Edward Rosenbluth, Yorktown Heights, both of NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/127,508

(22) Filed: Jul. 31, 1998

(51) Int. Cl.[7] ..... G09G 5/00
(52) U.S. Cl. ..... 345/147; 345/214
(58) Field of Search ..... 345/63, 147, 152, 345/138, 132, 214; 382/47

(56) References Cited

U.S. PATENT DOCUMENTS

| | | | | |
|---|---|---|---|---|
| 5,402,513 | * | 3/1995 | Schafer | 382/47 |
| 5,504,504 | * | 4/1996 | Markandey et al. | 345/214 |
| 5,689,343 | * | 11/1997 | Loce et al. | 358/298 |
| 6,025,818 | * | 2/2000 | Okano | 345/214 |
| 6,034,663 | * | 3/2000 | Killebrew, Jr. et al. | 345/147 |
| 6,040,818 | * | 3/2000 | Minami et al. | 345/147 |

* cited by examiner

*Primary Examiner*—Amare Mengistu
(74) *Attorney, Agent, or Firm*—Scully, Scott, Murphy & Presser; Daniel P. Morris, Esq.

(57) ABSTRACT

The present invention describes a method and an apparatus for eliminating image artifacts due to imaging of post spacers, or other small clusters of pixels that deviate from nominal performance of light valve technology. This invention is applicable to imaging technologies whose pixels are separately addressable.

29 Claims, 9 Drawing Sheets

DISPLAY PIXEL AND POST SPACER LAYOUT

TYPICAL POST CORRECITON CURVE AS A FUNCTION OF DRIVING VOLTAGE

GREEN R-V CURVE

PARAMETRIC CURVE OF LOG10 (POST/NO-POST) LUMINANCE (GREEN CHANNEL)

POST LOOKUP TABLES GREEN

| 1 | 2 | 3 | 4 |
|---|---|---|---|
| 63 | 63 | 63 | 63 |
| 63 | 62 | 62 | 62 |
| 62 | 62 | 62 | 61 |
| 61 | 60 | 60 | 60 |
| 59 | 59 | 59 | 59 |
| 58 | 58 | 58 | 58 |
| 58 | 57 | 57 | 57 |
| 57 | 57 | 57 | 57 |
| 57 | 57 | 56 | 56 |
| 56 | 56 | 56 | 56 |
| 55 | 55 | 55 | 55 |
| 54 | 54 | 54 | 53 |
| 53 | 53 | 52 | 52 |
| 52 | 51 | 51 | 51 |
| 50 | 50 | 50 | 50 |
| 50 | 50 | 49 | 49 |
| 49 | 49 | 49 | 48 |
| 48 | 48 | 48 | 48 |
| 47 | 47 | 47 | 47 |
| 46 | 46 | 46 | 46 |
| 45 | 45 | 45 | 44 |
| 44 | 44 | 44 | 45 |
| 43 | 43 | 43 | 42 |
| 42 | 41 | 41 | 41 |
| 40 | 40 | 40 | 40 |
| 39 | 39 | 39 | 38 |
| 38 | 38 | 38 | 37 |
| 37 | 37 | 37 | 36 |
| 36 | 36 | 36 | 36 |

A A

Fig. 6a

A — A

| | | | |
|---|---|---|---|
| 35 | 35 | 35 | 35 |
| 34 | 34 | 34 | 33 |
| 33 | 33 | 33 | 32 |
| 32 | 32 | 31 | 31 |
| 31 | 31 | 30 | 30 |
| 30 | 29 | 29 | 29 |
| 29 | 28 | 28 | 28 |
| 28 | 27 | 27 | 27 |
| 26 | 26 | 26 | 26 |
| 25 | 25 | 25 | 24 |
| 24 | 23 | 23 | 23 |
| 23 | 22 | 22 | 22 |
| 22 | 22 | 21 | 21 |
| 21 | 20 | 20 | 20 |
| 20 | 20 | 19 | 19 |
| 19 | 18 | 18 | 18 |
| 18 | 18 | 17 | 17 |
| 17 | 17 | 16 | 16 |
| 16 | 15 | 15 | 15 |
| 15 | 14 | 14 | 14 |
| 14 | 13 | 13 | 13 |
| 12 | 12 | 12 | 12 |
| 11 | 11 | 11 | 11 |
| 10 | 10 | 10 | 10 |
| 9 | 9 | 8 | 8 |
| 4 | 4 | 4 | 4 |
| 4 | 3 | 3 | 3 |
| 3 | 3 | 2 | 2 |
| 2 | 2 | 2 | 1 |
| 2 | 1 | 1 | 1 |
| 0 | 0 | 0 | 0 |
| 0 | 0 | 0 | 0 |
| 0 | 0 | 0 | 0 |
| 0 | 0 | 0 | 0 |

Fig. 6b

| Levels | Post ... | | | ...LUT's |
|---|---|---|---|---|
| | 1 | 2 | 3 | 4 |
| 63 | 61 | 61 | 61 | 61 |
| 62 | 61 | 60 | 60 | 60 |
| 61 | 60 | 59 | 59 | 60 |
| 60 | 59 | 58 | 59 | 59 |
| 59 | 58 | 58 | 58 | 58 |
| 58 | 58 | 57 | 57 | 57 |
| 57 | 57 | 56 | 56 | 57 |
| 56 | 56 | 55 | 56 | 56 |
| 55 | 55 | 55 | 55 | 55 |
| 54 | 54 | 54 | 54 | 54 |
| 53 | 53 | 53 | 53 | 53 |
| 52 | 52 | 52 | 52 | 52 |
| 51 | 51 | 51 | 51 | 51 |
| 50 | 50 | 50 | 50 | 50 |
| 49 | 49 | 49 | 49 | 49 |
| 48 | 48 | 48 | 48 | 48 |
| 47 | 47 | 47 | 47 | 47 |
| 46 | 46 | 46 | 46 | 46 |
| 45 | 45 | 45 | 45 | 45 |
| 44 | 44 | 44 | 44 | 44 |
| 43 | 43 | 43 | 43 | 43 |
| 42 | 42 | 42 | 42 | 42 |
| 41 | 41 | 41 | 41 | 41 |
| 40 | 40 | 40 | 40 | 40 |
| 39 | 39 | 39 | 39 | 39 |
| 38 | 38 | 38 | 38 | 38 |
| 37 | 37 | 37 | 37 | 37 |
| 36 | 36 | 36 | 36 | 36 |

A A

*Fig. 7a*

CAMOUFLAGE OF IMAGED POST SPACERS AND COMPENSATION OF PIXELS THAT DEPART FROM NOMINAL OPERATING CONDITIONS BY LUMINANCE DIFFUSION

BACKGROUND OF THE INVENTION

1. Field of the Invention

The present invention is directed to imaging devices whose pixels are separately addressable, and more particularly to the elimination of artifacts in light valves and liquid crystal displays caused by post spacers and other departures from nominal operation.

2. Description of Prior Art

A typical light valve comprises a thin layer of liquid crystals interposed between two glass plates coated with thin layers of transparent conductors such as indium tin oxide and polymer alignment films. Light valves and liquid crystal displays generate images by modulating the amount of transmission, reflection and scattering of an incoming light source.

In a typical liquid crystal display polarizers are on the top glass plate as well as on the bottom glass plate. On reflective light valves, the bottom glass plate is replaced by a reflective mirror. The pixels are individually addressed by a matrix of conducting electrodes and typically driven by transistors fabricated on a silicon or amorphous silicon substrate.

The liquid crystals' orientation above each pixel can be changed, based on its optical anisotropy, by driving the transistor at different voltages. By changing the liquid crystals' orientation, incoming polarized light from one polarizer can be rotated, thereby determining the amount of light transmitted through the other polarizer. The amount of reflected or scattered light in a reflective light valve or a liquid crystal display is determined by the rotation of the polarized light and the reflection of the mirror layer.

During the assembly of light valves and liquid crystal displays it is critically important to maintain uniformity in the gap distance occupied by the liquid crystals. It is also critically important to prevent contamination of the liquid crystal layer. In the practical manufacturing of light valves and liquid crystal displays, the cost can be significantly reduced if the fabrication tolerances permit a small number of defective pixels whose operation is perceptibly different from nominal operating conditions. There are many reasons for these defects, such as shorts and opens in the conductor electrodes, transistors that operate away from nominal operating conditions, non-uniform charge retention, contamination during processing, defective mask steps during photolithography and non-uniform cell gap control.

In liquid crystal displays or projection systems it is essential to achieve a good cell gap control, even as simultaneously attempts are made to reduce voltage to the minimum level consistent with the driver technology employed. To obtain optimal response with many liquid crystal modes, such as twisted nematic for example, accurate control of cell gap is essential in order that uniform grey scale, fast switching speeds, and high contrast be maintained over the cell.

In modern display technologies, the liquid crystals operate in modes that require strict tolerance and uniformity in the cell gap over the full area of the display. One solution for maintaining a good cell gap between the glass layers is to use interposing post spacers in the pixel array region. Post spacers are sometimes referred to just as spacers or posts. Fortunately, when light valves based on silicon technology are used, it becomes fairly straight forward to place these spacers in the boundaries between the pixel mirrors within the cell. These boundaries are dark, so the spacers are not easily seen directly. However, the post still perturbs the liquid crystal alignment above the mirrors of the surrounding pixels, causing changes in the polarization efficiency of the liquid crystals in the region around the posts. Changes in the polarization efficiency change the luminance and the chrominance in the vicinity of post spacers when the light valve is imaged on the screen. Even with a minimum resolution post element, delineated by modern fine-line lithography, the posts will still show artifacts when imaged.

Shadowing from the rubbing of liquid crystals will make the imaged artifacts still more visible. The shape of the post can be physically modified to reduce post artifacts, but this increases the fabrication difficulty and does not provide a solution for artifact elimination over the full luminance range generated by the display.

These defects detract from the appearance of images and therefore limit the commercial usefulness of a display. What is needed is a way to deploy posts without creating imaged artifacts. This method must be robust in dealing with variability in cell process and changing illumination conditions.

SUMMARY OF THE INVENTION

The object of the present invention is to provide a method and an apparatus for eliminating image artifacts due to imaging of post spacers, or other small clusters of pixels that deviate from nominal performance of light valve technology. The present invention is equally applicable for correction of sub-pixel defects and column disclinations and can be applied to any display technology that has matrix addressed pixels.

The driving voltages of each pixel in a neighborhood region of a post or cluster of pixels that deviate from nominal, are modified to eliminate image artifacts and improve image quality. The image artifacts, due to post spacers perturbing the liquid crystal alignment in a light valve, will usually either reduce or increase the perceived luminance in the neighborhood of a post spacer as compared with a similar region without a post spacer. Due to the imperfection in the light valve fabrication or pixels whose performance diverges from the norm the image artifacts can be corrected or greatly compensated to improve image uniformity and quality. The tonal quality can be improved by adjustment of the driving voltage of the neighborhood pixels surrounding post or pixel defects.

The above-mentioned image artifacts can be effectively camouflaged by utilizing the properties of the human visual system (HVS). Different sets of neighborhood correction voltages will be used for each of the primary colors (RGB) that are typically used in a three-cell liquid crystal light valve projector, so that the different wavelength response of each cell can be accounted for.

The apparatus consists of look up tables for neighborhood pixels surrounding a post or cluster of pixels that deviate from the norm. These tables will replace the incoming pixel grey values with values that will adjust the luminance and chrominance of the region encompassing defective pixels or post spacers to match the luminance and chrominance of the surrounding background.

Address decoding must be performed to determine whether the input stream is in the neighborhood of a post pixel and to route the input stream to the look up tables. This is implemented with either a field programmable gate array (FPGA) or a combination of a content addressable memory (CAM) and FPGA logic. The look up tables will output corrected pixel grey values. In effect, a correction voltage is thus applied to the liquid crystals of the neighborhood pixels surrounding a post.

BRIEF DESCRIPTION OF DRAWINGS

FIGS. 6 and 7 are post lookup tables.

DETAILED DESCRIPTION OF THE INVENTION

The present invention provides a method for eliminating or reducing visually perceptible artifacts in images produced by a pixel or a small cluster of pixels, when these pixels operate outside nominal operating conditions. The imaging of post spacers is an example of image artifacts that are effectively eliminated by applying the present invention. Nominal operating conditions for imaging of post spacers are the luminance values around four pixels where posts are not present.

Figure 1:
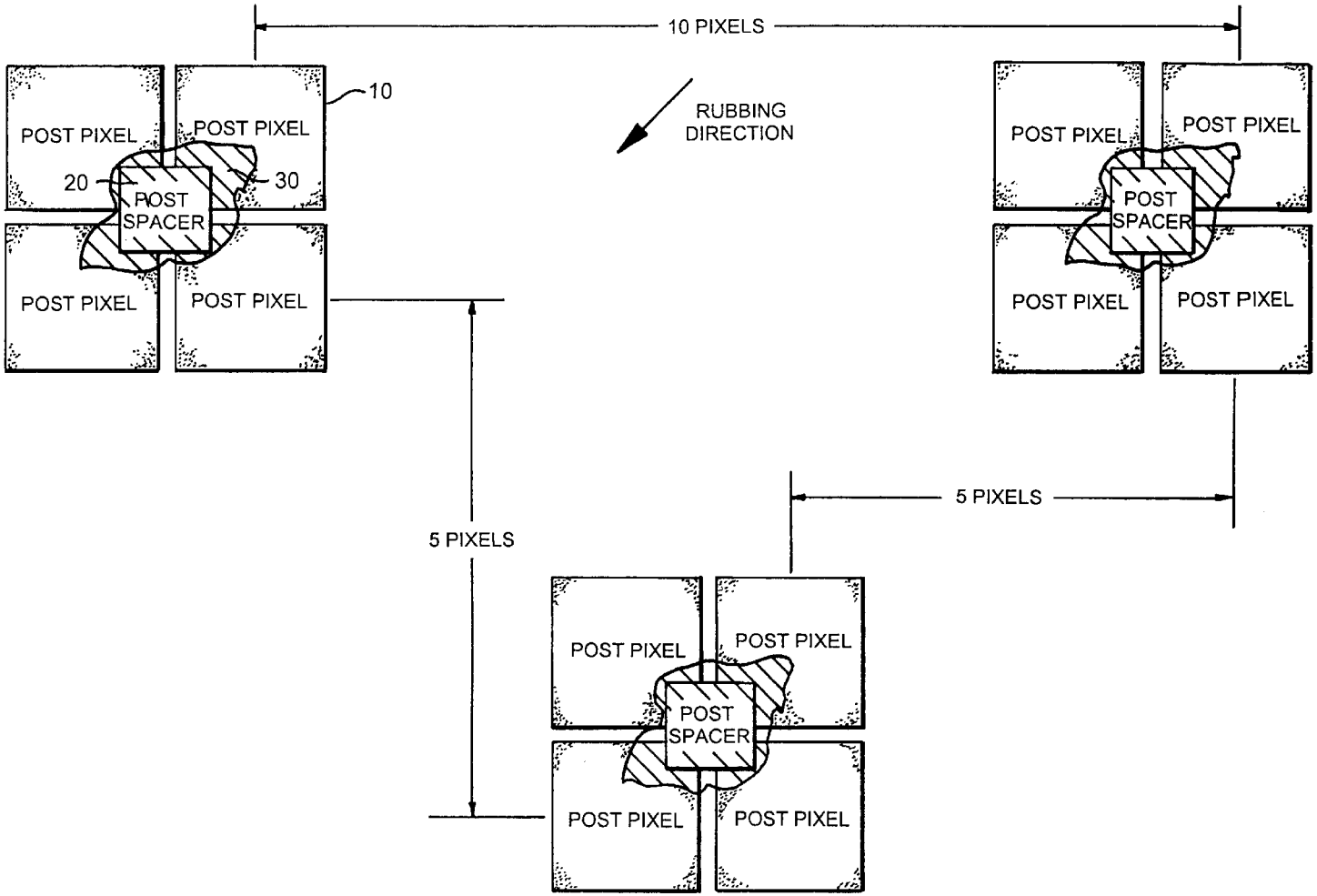
FIG. 1 shows a typical display pixel and post spacer layout.

The preferred embodiment of the post camouflage technique is the electronic method where pixel intensity levels are adjusted via adjustment of the driving voltage of pixels in the neighborhood of posts. FIG. 1 shows a typical post layout. The liquid crystals are perturbed in the four pixels 10 surrounding the post 20 (post pixels). Post pixels 10 may include other pixels beyond the four already described. The post 20 layout and the pixel structure will determine which post pixel 10 voltages are modified for the post camouflage 30.

Figure 2:
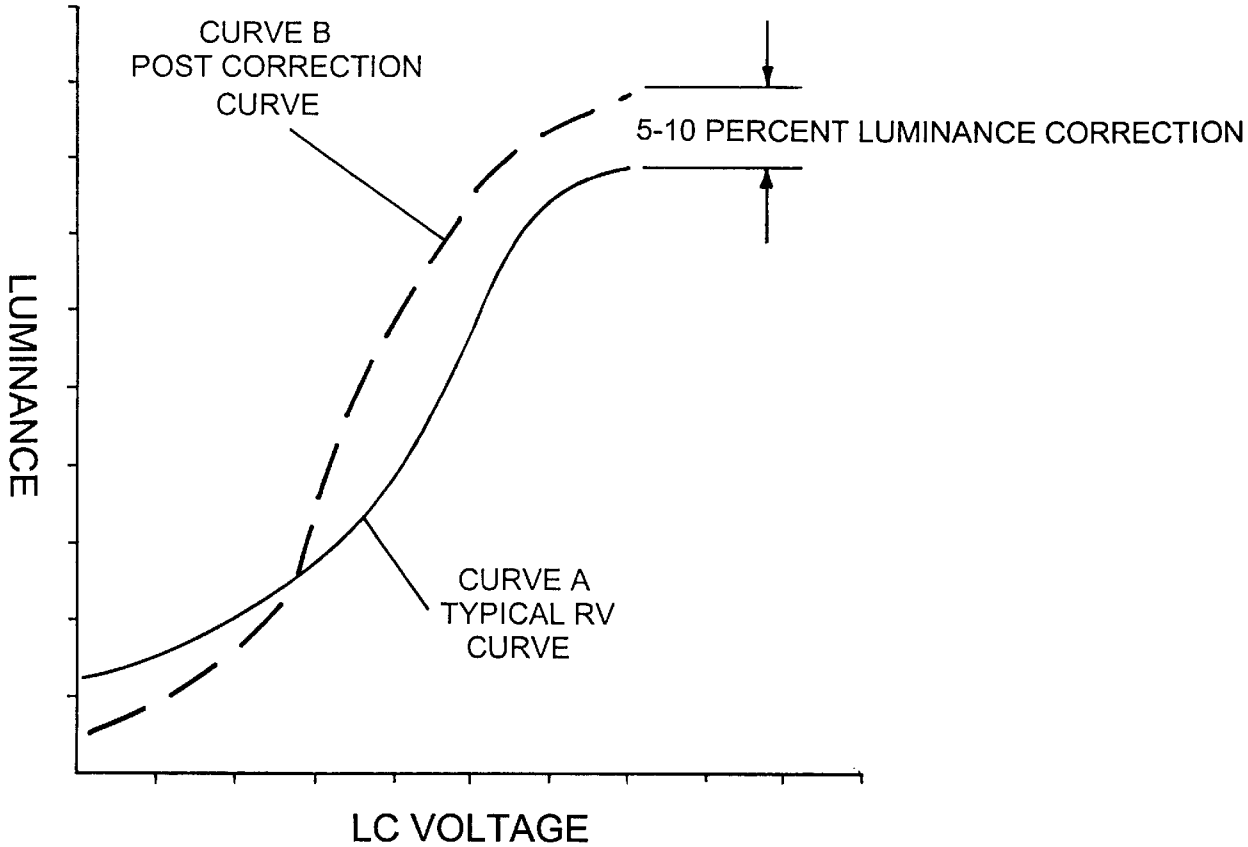
FIG. 2 is a graph of a post correction curve and a typical RV curve.

Curve A, shown in FIG. 2, is a typical representation of the luminance as a function of increasing voltage excitation of liquid crystals. Post correction curve B is a nonlinear function of voltage. Curve B represents the nominal luminance for a given voltage that is required for post camouflage 30 (FIG. 1) of imaged artifacts surrounding a post. Because of the perturbation introduced by the post 20 (FIG. 1), the neighboring image region is perceived to have the correct luminance, represented by curve A, when nominally driven to the luminance plotted in curve B.

In the example presented in FIG. 2, when the nominal voltage driving liquid crystals is low, the post pixels are driven to still lower luminance via a corresponding reduction in excitation voltage. Similarly, when the nominal voltage driving liquid crystals is high, the post pixels 10 (FIG. 1) are driven to a still higher luminance with an increased excitation voltage. A typical post correction of the luminance at maximum operating voltage is 5%.

Figure 3:
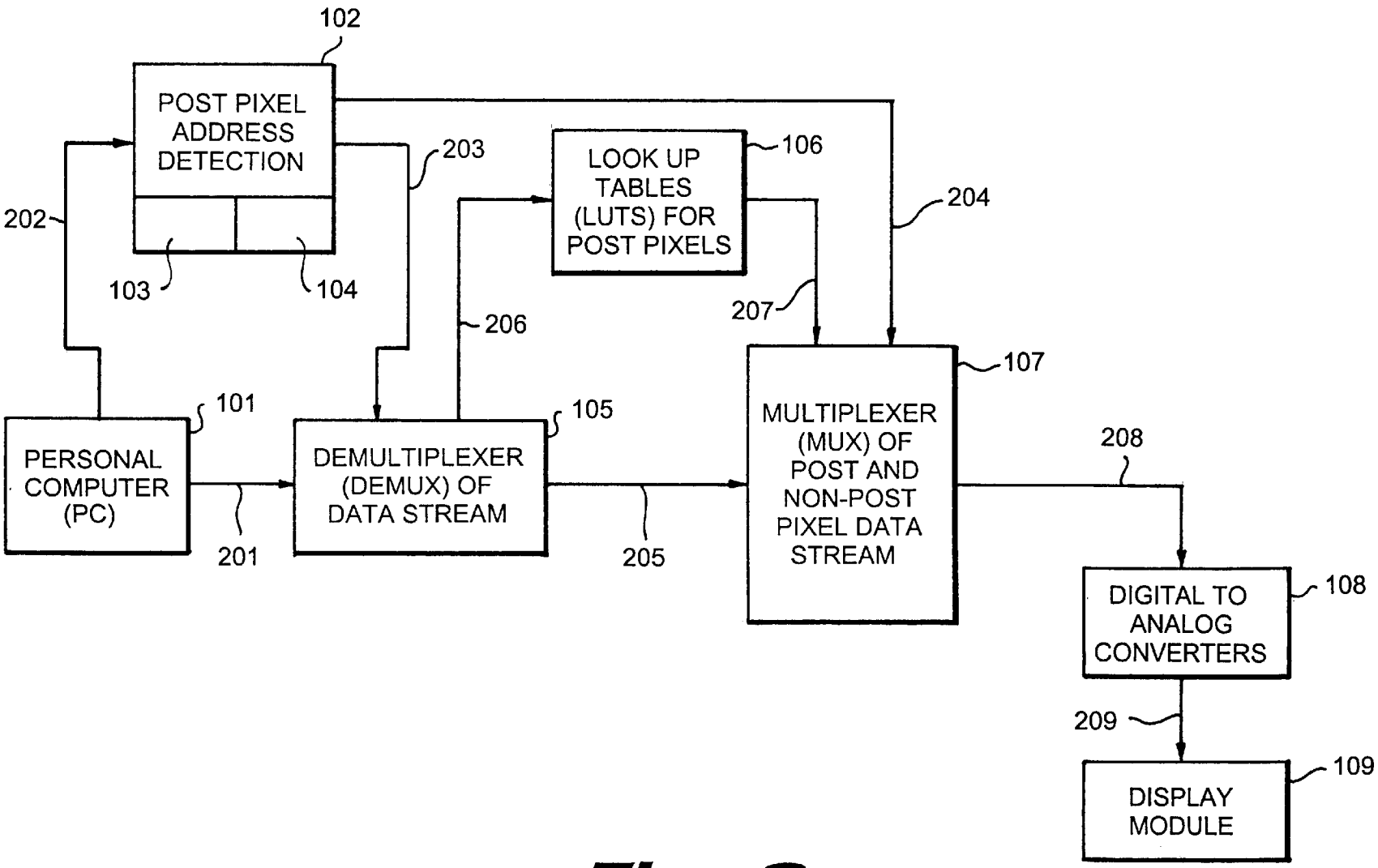
FIG. 3 is a block diagram of a post correction apparatus of the present invention.

A different adjustment must be made in the voltage applied to post pixels 10 (FIG. 1) for each different nominal background level. The preferred embodiment of the present invention achieves that through an apparatus shown in FIG. 3. A software implementation of this embodiment can also be achieved. FIG. 3 shows a source 101, such as a personal computer, of the image data stream 201, and the control data stream 202. The "POST PIXEL ADDRESS DETECTION" module 102 detects the address of post pixels using the "LINE COUNTER" sub-module 103 and the "PIXEL COUNTER" sub-module 104. If the current pixel in the data stream is adjacent to a post, the pixel value 203 is routed to the "DEMULTIPLEXER OF INPUT DATA STREAM" module 105 that sends the demultiplexed data 206 to the correction, "LOOK UP TABLES FOR POST PIXELS" module 106. Module 106 contains post pixels lookup tables for modification of the grey value. The corrected data 207 is multiplexed by the "MULTIPLEXER POST AND NON-POST PIXEL DATA STREAM" module 107 with the non-post pixel data stream 205 from the module 105, and control signals 204 from the module 102. The output data stream 208 is then sent through "DIGITAL TO ANALOG CONVERTERS" module 108, which outputs the final output image data 209 to a "DISPLAY MODULE" 109. If the pixels in the input data stream, as determined by the module 102, are not adjacent to a post the grey value is not modified by the correction logic.

Where the dynamic range of the display is not sufficient to provide post correction intensities needed across all gray levels, pixels in the non-post pixel data stream can be remapped to a compacted intensity range. Lookup tables 106 (FIG. 3) are initially generated via a software implementation of trial adjustments. Correction parameters are determined in an initial display unit using trial adjustment software and are then replicated in later units.

Correction parameters for the initial display unit can be established by displaying on the screen a 2D post correction gradient. Gray level is varied along one axis of this displayed image, while the degree of post correction is varied along the perpendicular axis. By clicking along the fringe of best correction using a PC input device, for example a mouse, a user can provide the software with a specification of the optimum correction for each nominal gray level. Alternatively, an automated viewing system can capture screen images at a resolution comparable to that of the human eye, allowing the optimum correction to be determined as that correction value that makes the posts least detectable.

Figure 4:
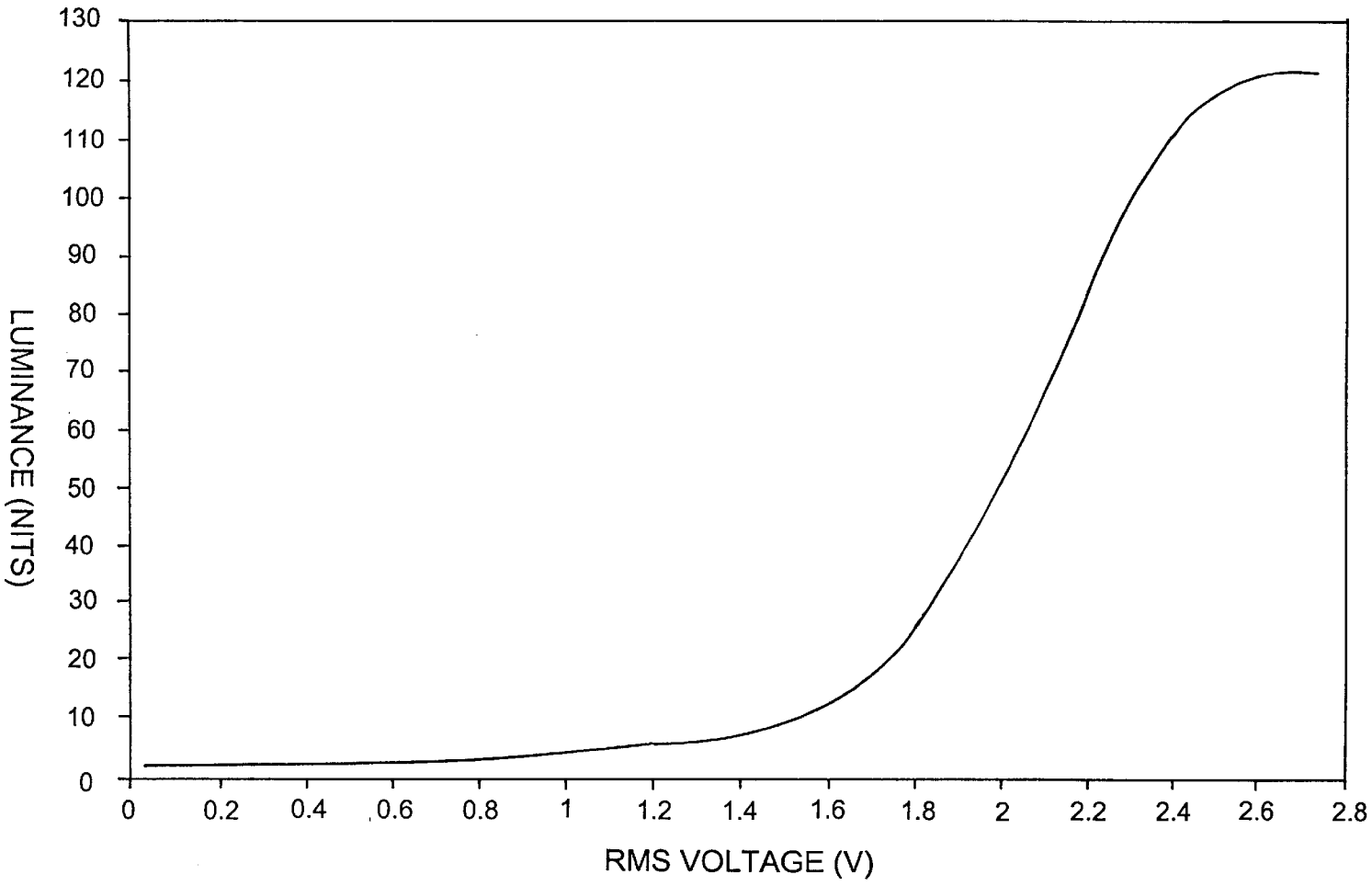
FIG. 4 is a Green RV Curve graph, shown as a function of luminance and voltage.
Figure 5:
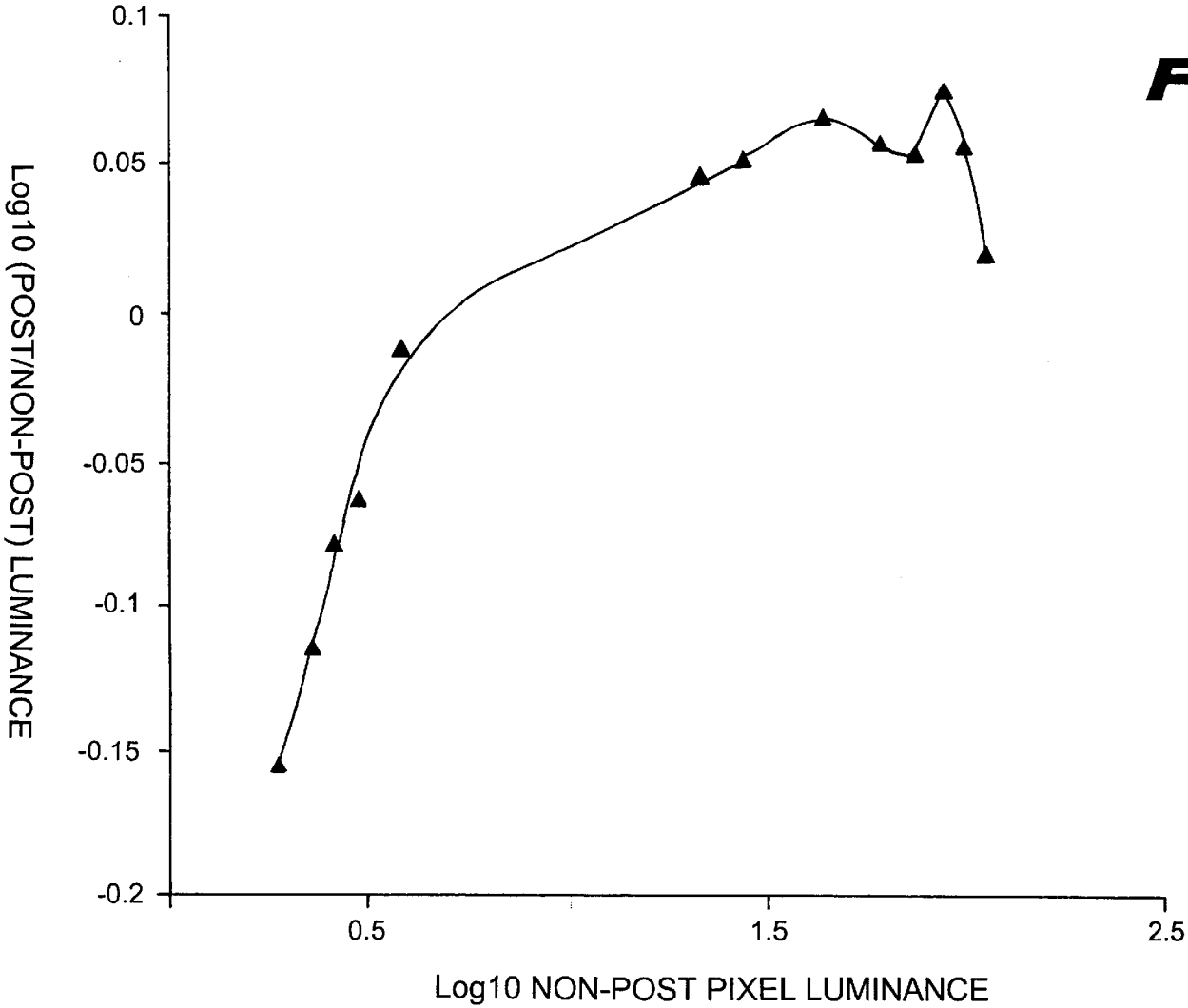
FIG. 5 is a Green Post Parametric Curve graph shown as a function of log10 post/non-post luminance and log10 non-post pixel luminance.

As an illustration, FIG. 4 shows the Green RV Curve, the voltage response curve for the green channel of a prototype 1280×1024 pixels display. The fractional change in the luminance required in post pixels to match their intensity with the remainder of the image is plotted in the green post parametric curve of FIG. 5. The table, shown in FIG. 6, remaps the data in the post-pixel data stream 206 (FIG. 3) given 6-bit input levels 0–63. The 4 columns of the table refer to the four pixels adjacent to each post. 64 rows of the table, not counting the top row labeling the columns, refer sequentially to the 64 possible values for the input data, beginning from level 63 for the top row.

Figure 7B:
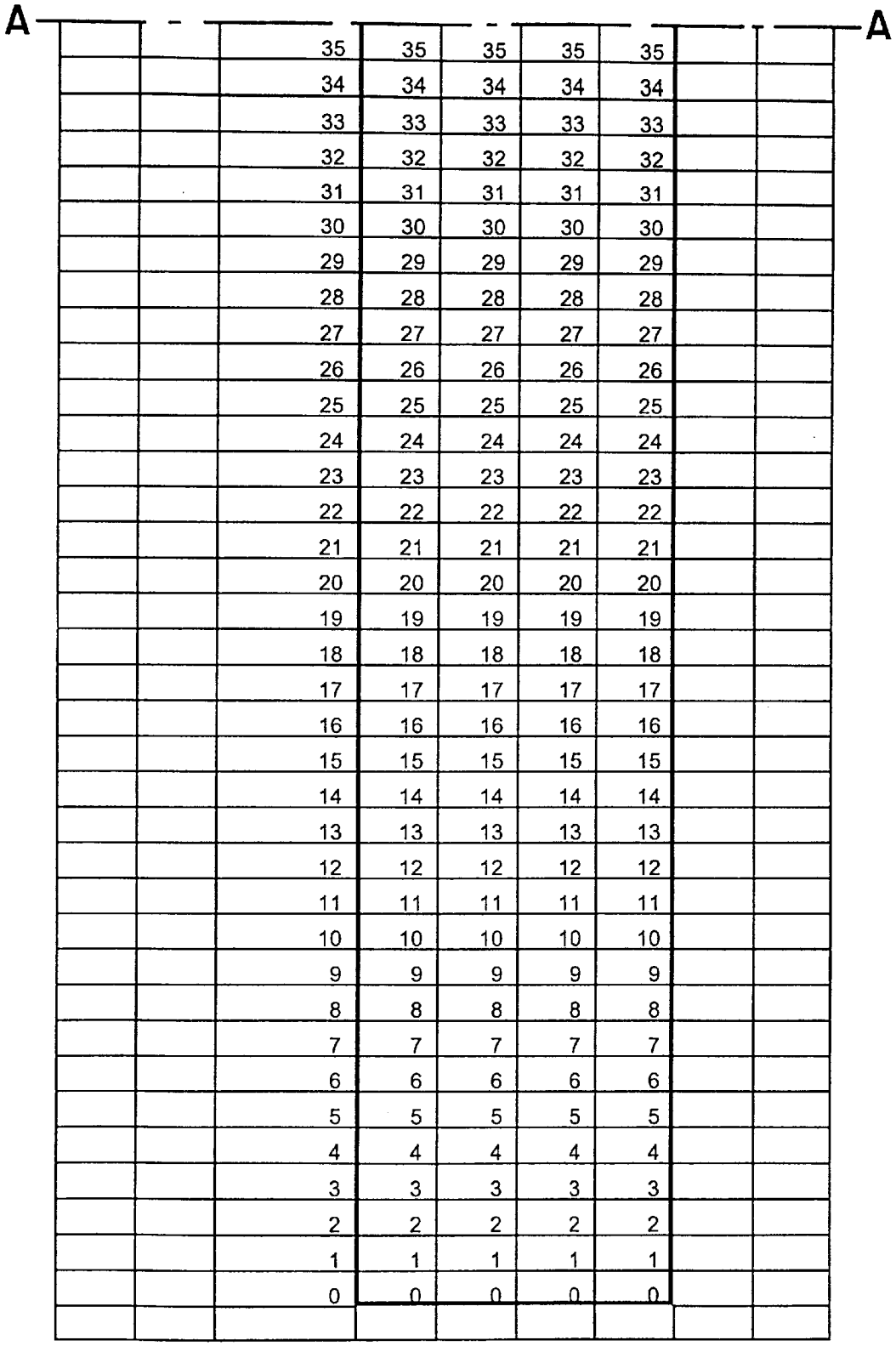

The table in FIG. 7 shows how the non-post pixels are also remapped to place nearly all of the display's dynamic range within the luminance range where post correction is possible. By alternating this latter remapping between the values in the 4 columns of the table, either temporally or spatially, luminances associated with interpolated gray levels can be displayed, e.g., on a 0–255 scale. After correction was implemented using the parameters in FIGS. 4–7, the posts were rendered virtually invisible in all but the few dimmest levels. This virtual invisibility is maintained in images that are densely detailed.

Techniques of the present invention are not limited to the correction of image artifacts resulting from spacer posts.

These techniques can be applied whenever the departure of a subset of pixels from nominal operation is sufficiently small that when a correcting intensity is imparted to pixels in the neighborhood of the non nominal image region, the HVS cannot perceive the fine-scale variation of intensity within this neighborhood, and can only perceive that the integrated intensity within the neighborhood has been restored to the nominal operating conditions.

This invention is not limited to the correction of static image artifacts. Because the correction is made in real-time, it can be applied to any predictable non uniformity that affects small regions of the image, so long as the average intensity within each resolvable element of these image regions departs slightly from nominal operating conditions, even if the artifacts are time-varying.

While the invention has been particularly shown and described with respect to illustrative and preferred embodiments thereof, it will be understood by those skilled in the art that the foregoing and other changes in form and details may be made therein without departing from the spirit and scope of the invention that should be limited only by the scope of the appended claims.

Having thus described our invention, what we claim as new, and desire to secure by Letters Patent is:

1. A method for improving the perceived uniformity of image intensities that deviate from nominal operating conditions, the method comprising:

supplying a data stream;

determining a pixel address for each pixel of said data stream;

separating said data stream into post image data and non-post image data;

correcting said post image data; and combining said non-post image data and said corrected post image data into output data.

2. The method of claim 1, wherein said data stream comprises image data and control data.

3. The method of claim 2, further comprising steps of accepting said control data and separating it into pixel values and control signals for identifying nominal regions and non-nominal regions.

4. The method of claim 1, wherein the step of separating said data stream comprises receiving said image data and said pixel address.

5. The method of claim 1, wherein the step of correcting comprises utilizing correction value tables for non-nominal image regions.

6. The method of claim 5, wherein the step of correcting comprises restoring the average intensity in the neighborhood of said non-nominal image region to the nominal value.

7. The method of claim 3, wherein the step of combining comprises receiving said control signal.

8. The method of claim 1, further comprising converting said output data.

9. The method of claim 8, further comprising displaying converted output data.

10. An apparatus for improving the perceived uniformity of image intensities that deviate from nominal operating conditions, the apparatus comprising:

means for supplying a data stream;

means for determining a pixel address for each pixel of said data stream;

means for separating said data stream into post image data and non-post image data;

means for correcting said post image data; and means for combining said non-post image data and said corrected post image data into output data.

11. The apparatus of claim 10, wherein said data stream is supplied by a computer.

12. The apparatus of claim 10, wherein said data stream comprises image data and control data.

13. The apparatus of claim 10, wherein said means to determine a pixel address accepts said control data and separates it into a pixel value and a control signal for identifying nominal regions and non-nominal regions.

14. The apparatus of claim 10, wherein said means to determine a pixel address comprises a line counter module and a pixel counter module.

15. The apparatus of claim 10, wherein the means for separating data stream receives said image data and said pixel address.

16. The apparatus of claim 10, wherein said means for correcting said post image data utilizes correction value tables for non-nominal image regions.

17. The apparatus of claim 16, wherein said means for correcting said post image data restores the average intensity in the neighborhood of said non-nominal image region to the nominal value.

18. The apparatus of claim 13, wherein said means for combining said non-post image data and said corrected post image data receives said control signal.

19. The apparatus of claim 10, further comprising a means to convert said output data.

20. The apparatus of claim 10, further comprising a means to display said converted output data.

21. A computer program device readable by a machine, tangibly embodying a program of instructions executable by a machine to perform method steps for improving the perceived uniformity of image intensities that deviate from nominal operating conditions, the method comprising:

supplying a data stream;

determining a pixel address for each pixel of said data stream;

separating said data stream into post image data and non-post image data;

correcting said post image data; and combining said non-post image data and said corrected post image data into output data.

22. The computer program device of claim 21, wherein said data stream comprises image data and control data.

23. The computer program device of claim 22, further comprising steps of accepting said control data and separating it into pixel values and control signals for identifying nominal regions and non-nominal regions.

24. The computer program device of claim 21, wherein the step of separating said data stream comprises receiving said image data and said pixel address.

25. The computer program device of claim 21, wherein the step of correcting comprises utilizing correction value tables for non-nominal image regions.

26. The computer program device of claim 25, wherein the step of correcting comprises restoring the average intensity in the neighborhood of said non-nominal image region to the nominal value.

27. The computer program device of claim 23, wherein the step of combining comprises receiving said control signal.

28. The computer program device of claim 21, further comprising converting said output data.

29. The computer program device of claim 28, further comprising displaying converted output data.

* * * * *